US005301928A

United States Patent [19]

Stomp et al.

[11] Patent Number: 5,301,928

[45] Date of Patent: Apr. 12, 1994

[54] BLOWING LANCE SUSPENSION WITH INTEGRATED MEDIUM SUPPLY

[75] Inventors: Hubert Stomp, Luxembourg-Howald; Andre Kremer, Leudelange, both of Luxembourg; Daniel Fries, Arlon, Belgium; Marc Reichert, Schifflange, Luxembourg

[73] Assignee: Paul Wurth S.A., Luxembourg

[21] Appl. No.: 4,896

[22] Filed: Jan. 19, 1993

[30] Foreign Application Priority Data

Jan. 25, 1992 [LU] Luxembourg ..... LU 88 057

[51] Int. Cl.[5] ..... C21C 5/46

[52] U.S. Cl. ..... 266/225

[58] Field of Search ..... 266/225, 226

[56] References Cited

U.S. PATENT DOCUMENTS 3,972,515 8/1976 Mercatoris ..... 266/225

4,893,791 1/1990 Stomp ..... 266/225

*Primary Examiner*—Peter D. Rosenberg

*Attorney, Agent, or Firm*—Fishman, Dionne & Cantor

[57] ABSTRACT

The invention relates to a blowing lance suspension with integrated medium supply. In accordance with this invention, a U-shaped medium collector box having a horizontal top plate as carrier arm and a first connection surface is provided on the lance carriage. The medium connection pipes lead into this first connection surface. A lance carrier plate is provided, at right angles to the longitudinal axis of the lance, on the top part of the lance. The underside of the lance carrier plate forms a second connection surface into which the medium distributor pipes of the lance lead fittingly. After the lance has been laid down on the carrier arm of the lance carriage, the lance carrier plate is carried by the horizontal top plate, so that between the first and second connection surfaces, the connection of the medium pipes is made through the action of gravity.

9 Claims, 6 Drawing Sheets

BLOWING LANCE SUSPENSION WITH INTEGRATED MEDIUM SUPPLY

BACKGROUND OF THE INVENTION

This invention relates to a blowing lance suspension with an integrated medium supply for metallurgical blowing lances wherein the blowing lance is mounted on a blowing lance carriage. More particularly, this invention relates to a blowing lance suspension having connection surfaces between the top part of the blowing lance and the lance carriage that lie substantially horizontal.

Blowing lance suspensions having integrated medium supply and horizontal connection surfaces between the lance and the medium supply device are known per se. The primary characteristic of these known arrangements (see for example the patent specifications LU-69-797 corresponding to U.S. Pat. No. 3,972,515 which is assigned to the assignee hereof and incorporated herein by reference and LU-86-985 corresponding to U.S. Pat. No. 4,893,791, which is assigned to the assignee hereof and incorporated herein by reference) is that the primary connection surface points downwards. In contrast, the secondary connection surface, that is, the connection surface belonging to the lance, points upwards.

In the prior art, in order to obtain secure leaktight coupling of the lance to the medium supply device, the lance must be raised by a hoisting device upwardly to the primary connection surface. The lance is rigidly coupled to the medium supply device by means of a coupling device. It will be appreciated that the two operations of raising and coupling are disadvantageously carried out against the pull of gravity.

In addition, the coupling device with its associated drive mechanism, even in an improved version (see patent specification LU-88-017, corresponding to U.S. application Ser.No. 921,327 filed Oct. 13, 1992, which is assigned to the assignee hereof and incorporated herein by reference) is still quite expensive.

Another disadvantage of the device proposed in Ser. No. 921,327 is that a transport clevis must be provided between the crane hook and the top part of the lance in order to transport the lance. This is required in order to bring the top part of the lance to a position under the medium supply device. The removal of this transport clevis after positioning the lance under the medium supply device as well as the initial attachment of the clevis entail complicated manipulations. Moreover, the minimum width of this clevis is determined by the width of the medium supply device, and therefore the lance approach corridor must have a greater than normal width.

SUMMARY OF THE INVENTION

The above-discussed and other problems and deficiencies of the prior art are overcome or alleviated by the present invention. In accordance with the present invention, a fork-shaped carrier arm for the lance is formed on the lance carriage as a medium collector box and has a top plate having a first, substantially horizontal connection surface in which first medium openings are provided. On the top part of the lance, a lance carrier plate is disposed at right angles to the longitudinal axis of the lance. The underside of this lance carrier plate forms a second substantially horizontal connection surface having second medium openings fittingly disposed therein. The second connection surface thus lies flush on the first connection surface when the lance is laid down on the carrier arm and medium collector.

The advantages achieved through this invention are several. In particular, in contrast to the prior art, the pull of gravity is utilized both in the mounting of the lance on the lance carriage and also for sealing the connection surfaces in rigid contact. The hoisting device on the lance carriage is no longer required and the coupling device for the lance has a substantially simpler construction. Furthermore, the transport clevis for the lance is not required, which results in substantial space-savings in the lance approach corridor and handling of the lances during transport is substantially simplified.

In a first preferred embodiment of this invention, a fastening and pressing device for the lance is disposed between the lance carriage and the top part of the lance. This device allows the lance to be pressed with the first contact surface against the second contact surface, and simultaneously allows the stem of the lance to be rigidly connected to the lance carriage. This fastening and pressing device thus reinforces the action of gravity, and through greater contact pressure, improves the leaktightness between the two connection surfaces. Through the rigid connection of the lance body to the lance carriage the stability of the lance suspension is substantially maintained and shock vibrations are absorbed directly in the lance carriage.

In a first embodiment of this invention, the fastening and pressing device comprises, on the lance carriage, a clamp device having a fork-shaped projecting arm which is vertically slidable on the lance carriage and can be hooked from above into two pins on the lance stem. This projecting arm can be pressed firmly against the pins on the lance by means of a vertical drive.

In a second embodiment of this invention, the fastening and pressing device comprises, on the lance carriage, a pair of swivel hooks which can engage in two pins on the lance stem and, with the aid of associated drives, can be pressed against the two pins on the lance stem in the direction in which the force of gravity acts.

In another preferred embodiment of this invention, the blowing lance suspension comprises coupling guides on the top plate and corresponding coupling guides on the lance carrier plate. These guides ensure that the medium openings in the two plates are brought together into accurate flush contact.

Lateral pipe connections for a gaseous blowing medium and flow and return pipes for a liquid coolant for the lance are preferably provided on the medium collector. These connections and pipes lead from below into the corresponding first medium openings in the first connection surface. Corresponding connecting pipes between the lance and the second medium openings in the second connection surface are provided in the top part of the lance. These pipes lead from above into the corresponding second medium openings.

In the first and second connection surfaces, corresponding connection members for electrical lines may also be provided if required.

A transport eye for the lance is fastened directly on the top part of the lance as a direct extension of the longitudinal axis of the lance and replaces the lance transport clevis.

The above discussed and other features and advantages of the present invention will be appreciated and understood by those skilled in the art from the following detailed description and drawings.

BRIEF DESCRIPTION OF THE DRAWINGS

Referring now the drawings, wherein like elements are numbered alike in the several FIGURES.

DESCRIPTION OF THE PREFERRED EMBODIMENT

Figure 1:
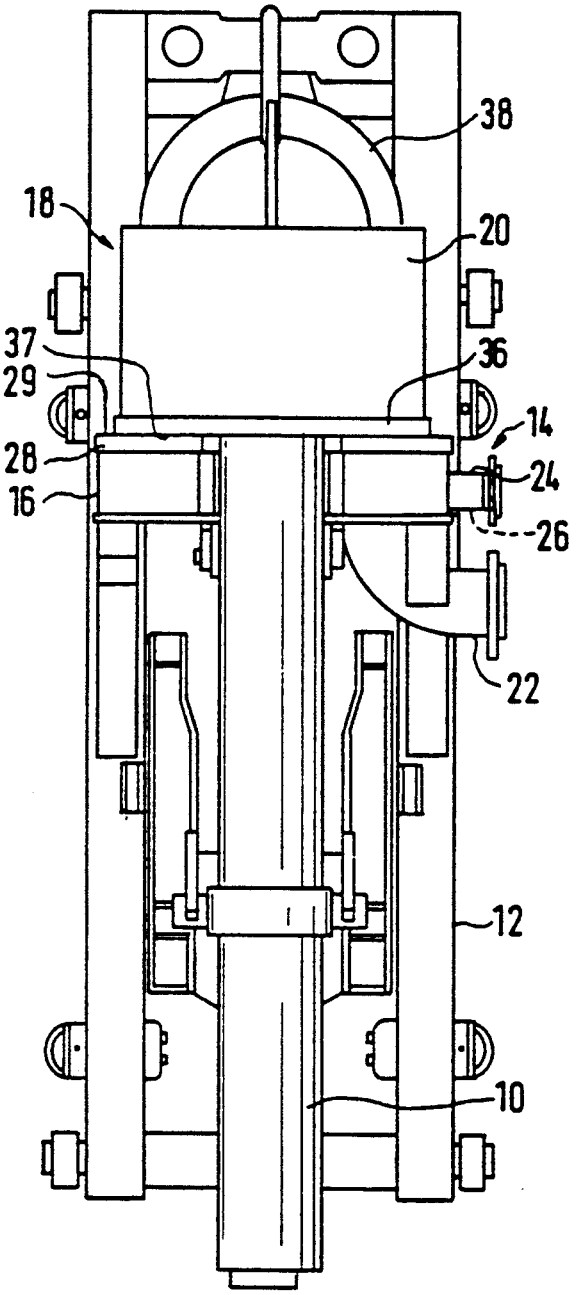
FIG. 1 is a front elevation view of a suspension in accordance with the present invention for a blowing lance on a lance carriage.
Figure 2:
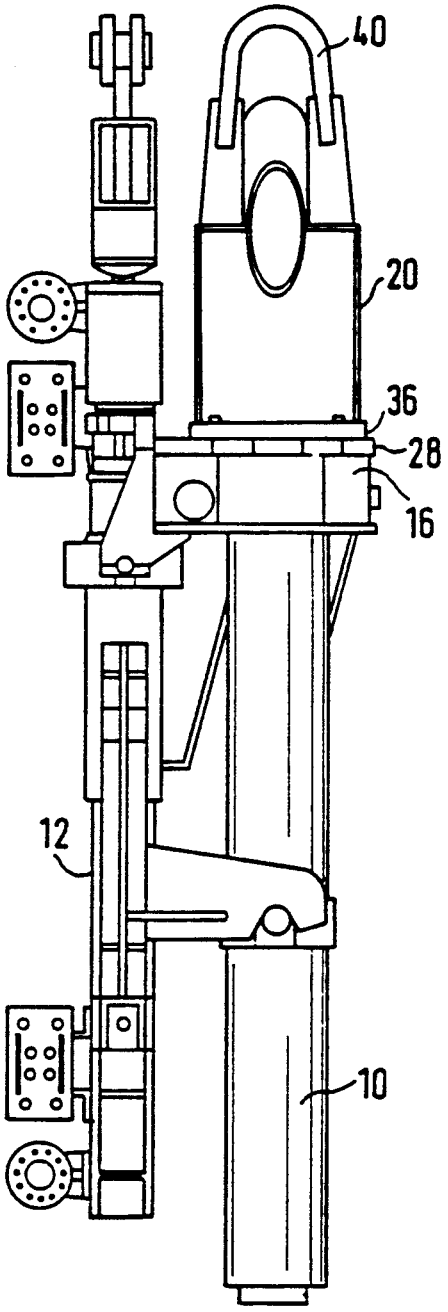
FIG. 2 is a side elevation view of the suspension shown in FIG. 1.
Figure 6:
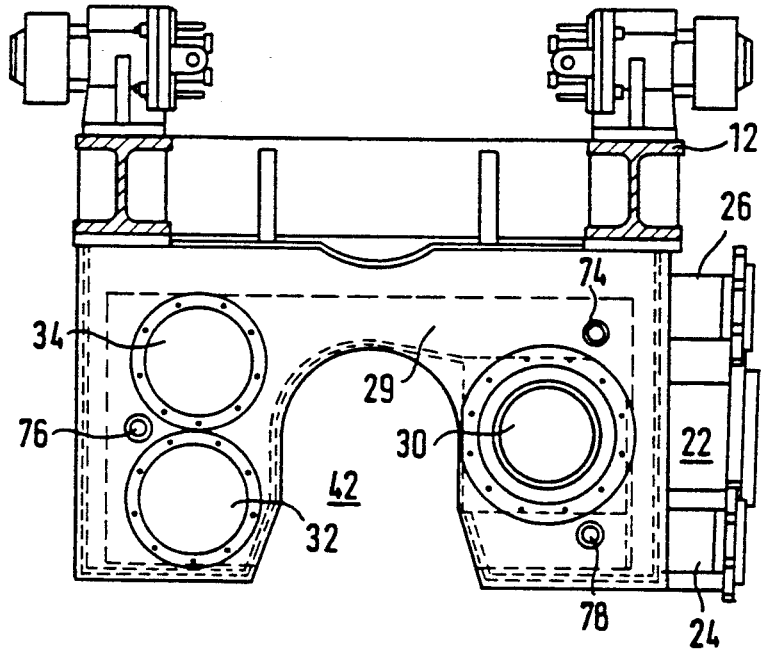
FIG. 6 is a plan view of the device shown in FIG. 5.
Figure 7:
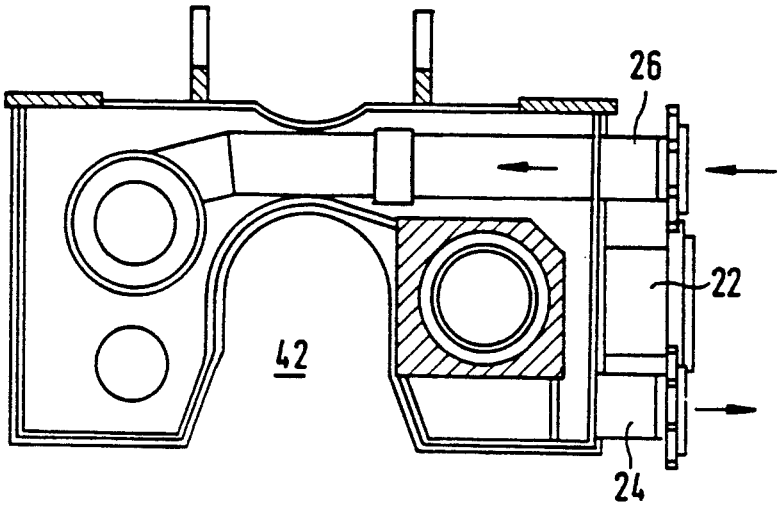
FIG. 7 is a cross-sectional view along the line A—A of FIG. 5.

FIG. 1 shows the top part of a lance 10, which is coupled to a lance carriage 12 and the medium connection device 14 of the lance carriage 12. This device 14 is mounted on a fork-shaped arm 16, preferably supported after the fashion of a bracket, on the carriage 12, said arm also serving as support mounting for the top part 18 of lance 10. The arm 16 is thus constructed as a medium supply device and, for the sake of simplicity, will also be referred to below as the medium collector or medium collector box 16. Medium collector box 16 is provided with pipe connectors 22, 24, 26 for the connection of medium pipes (not shown), the connector 22 being intended in the example illustrated for an oxygen supply, the connector 26 for a cooling liquid flow, and the connector 24 for a cooling liquid return. These different pipe connectors 22, 24, 26 are formed inside the medium collector 16 as medium pipes which lead out vertically upwards into corresponding medium openings in a horizontal top plate 28 (see FIG. 6 and 7). In FIG. 6, the opening 30 is the oxygen supply opening, the opening 32 is the inlet opening for the cooling medium, and the opening 34 is the outlet opening for the cooling medium.

It will be appreciated that, if necessary, other medium supply means can also be provided on the medium collector 16, for example, for additional metallurgical gases or for an electrical supply for operating electrical devices provided in the lance head. Connection members for measuring lines may likewise be provided.

Figure 8:
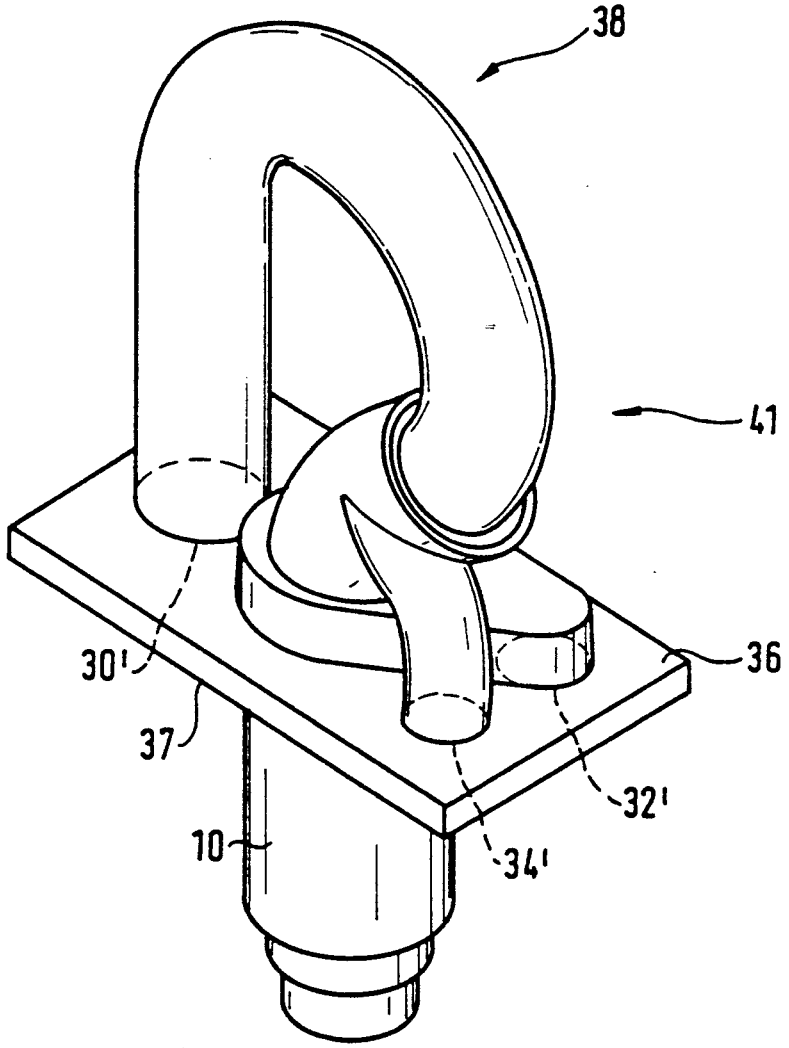
FIG. 8 is a view in perspective of one of many possible arrangements of the medium pipes between the top part of the lance and the lance carrier plate.

The top part of the lance comprises a medium supply casting 20, in which medium pipes 41 (FIG. 8) for the blowing process media and cooling media are disposed. At the top end of the lance 10, a carrier plate 36 is disposed at right angles to the longitudinal axis of the lance 10 (see FIGS. 1 and 8). After the lance 10 has been laid down on the lance carriage 12, said carrier plate rests on the surface 28 of the medium collector box 16, so that the lance 10 is carried by the top plate 28 of the medium collector. Openings 30', 32', 34' matching the openings 30, 32, 34 (see FIG. 8) are provided in this carrier plate 36 of the lance, appropriate peripheral seals (not explicitly shown) being of course provided for these various pairs of openings. The carrier plate 36 is covered by the medium supply casing 20, from which, in the example illustrated, the oxygen supply pipe 38 projects (see FIG. 8).

Figure 3:
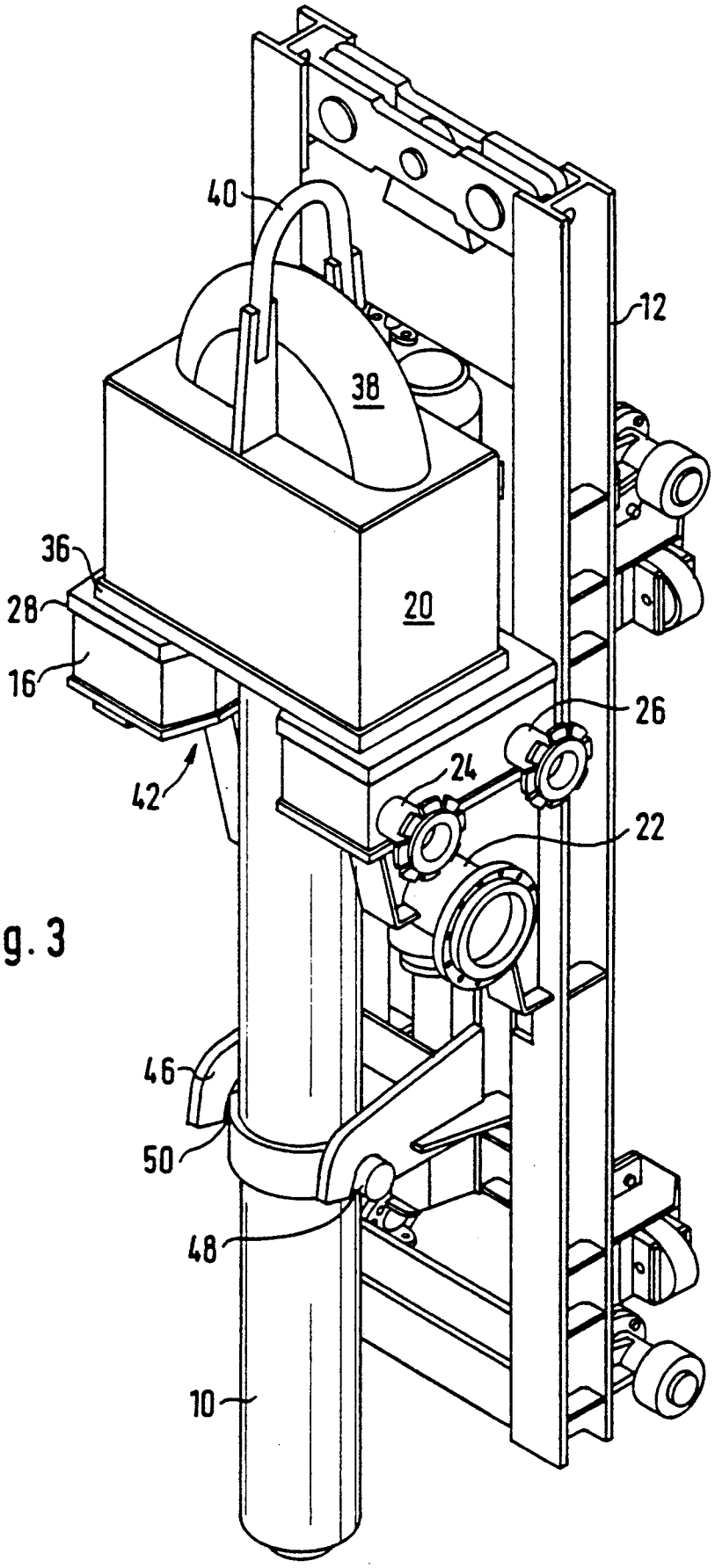
FIG. 3 is a prespective view of the suspension shown in FIG. 1.

The coupling operation for connecting the lance 10 and the lance carriage 12 can be explained with the aid of FIG. 3.

A lance 10 is brought from a lance reserve position (not shown) through a lance approach corridor (not shown), for example from the right, in front of the lance carriage 12 into a position of readiness for mounting. This is done, for example, with the aid of a crane trolley provided with a crane hook (not shown), the crane hook being engaged directly in a transport eye 40 on the lance 10. In this connection, it is an advantage that in accordance with the present invention a transport clevis, as previously mentioned, is no longer required, since the transport eye 40 can be disposed directly on the top part of the lance in line with the longitudinal axis of the lance 10.

Figure 5:
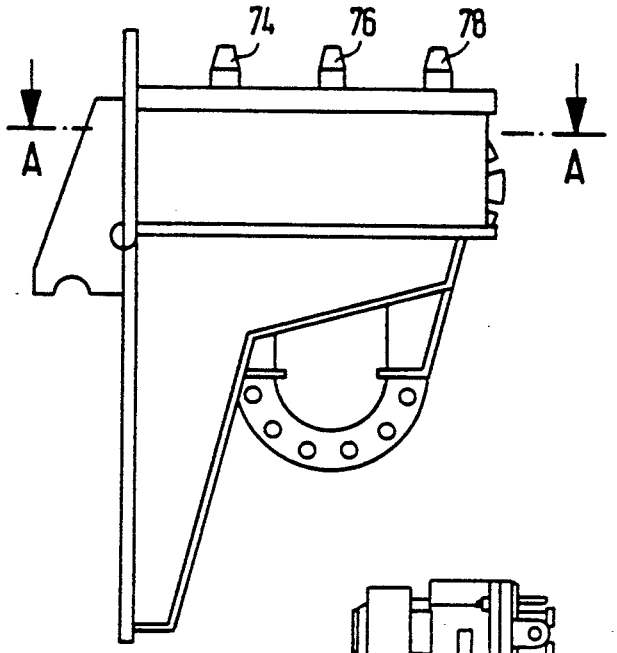
FIG. 5 is a side elevation view of a carrier arm, in the form of a medium collector box, for a lance.

The lance 10 is then introduced by means of the eye 40 into the recess 42 in the medium collector 16 and, by means of its carrier plate 36, is lowered onto the top plate 28 of the medium collector, guide pins 74, 76, 78 (FIGS. 5 and 6) on the top plate 28 engaging in corresponding guide bores in the carrier plate 36 (not shown), so that the corresponding medium openings in the two plates are brought together exactly flush with each other.

After the lance 10 has been laid down on the top plate 28, so that it is carried by top plate 28, the coupling is completed by pressing the two contact surfaces of the plates 36 and 28 firmly against one another to increase the sealing action. In the embodiment shown in FIGS. 3 and 4 this is done with the aid of a vertically slidable link slide device 44 (or roller device 44) (FIG. 4), on which a fork-shaped arm 46 is provided which can engage from above with pins 48, 50 disposed on both sides on the stem of the lance 10. If the arm 46 is moved downwards with the aid of device 44, not only is the desired pressing force between the plates 28 and 36 achieved, but the lance is also additionally supported, in the region of the arm 46, on the lance carriage 12 by means of said arm. After completion of this operation, the lance is thus immovably fastened to the carriage 12.

Figure 4:
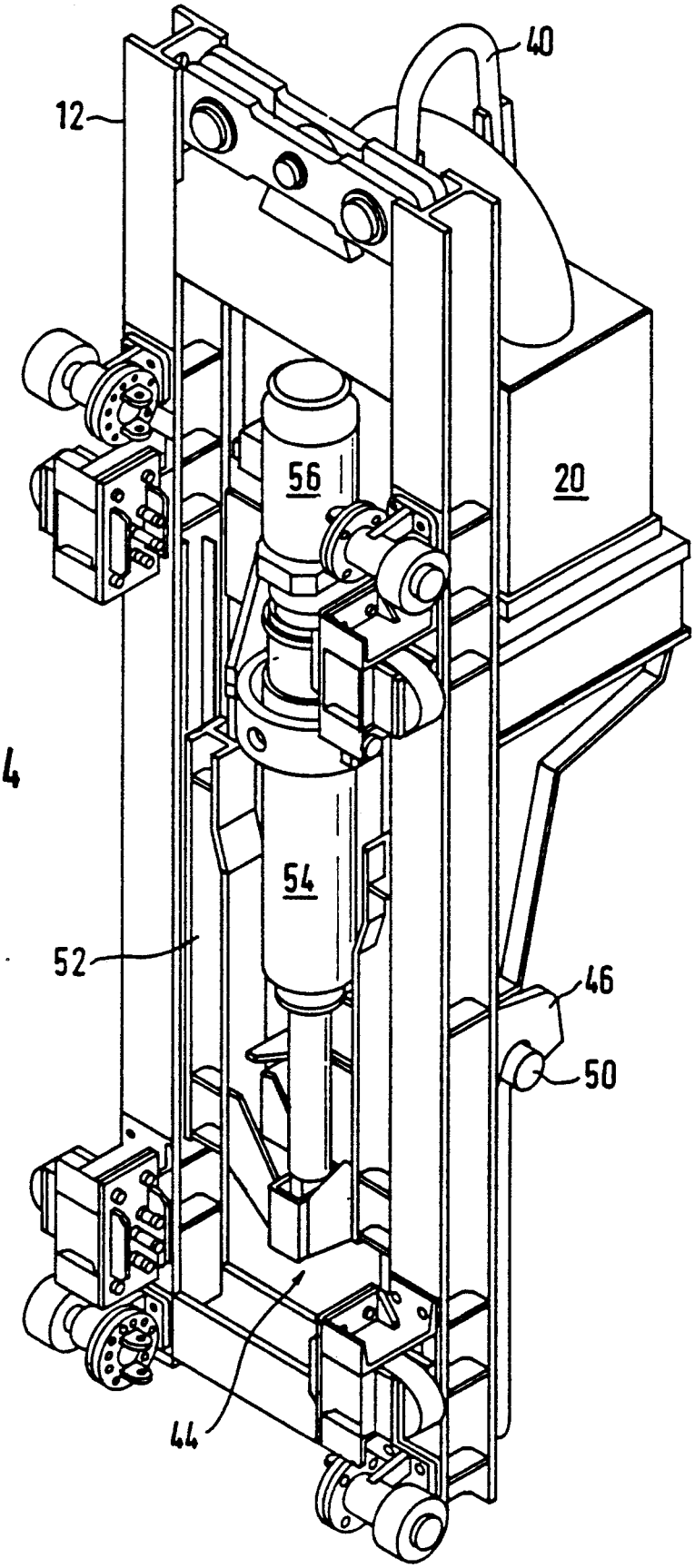
FIG. 4 is a rear elevation perspective view of the suspension shown in FIG. 3.

In FIG. 4 the basic details of the drive device for the arm 46 can be seen. The link slide 52 is here connected to a drive motor 56 via a spindle system 54, which converts the rotary movement of the drive motor 56 into the required linear movement.

It will be appreciated that the prior art offers many other possible ways of imparting a lifting movement to an arm 46 or the like.

Figure 9:
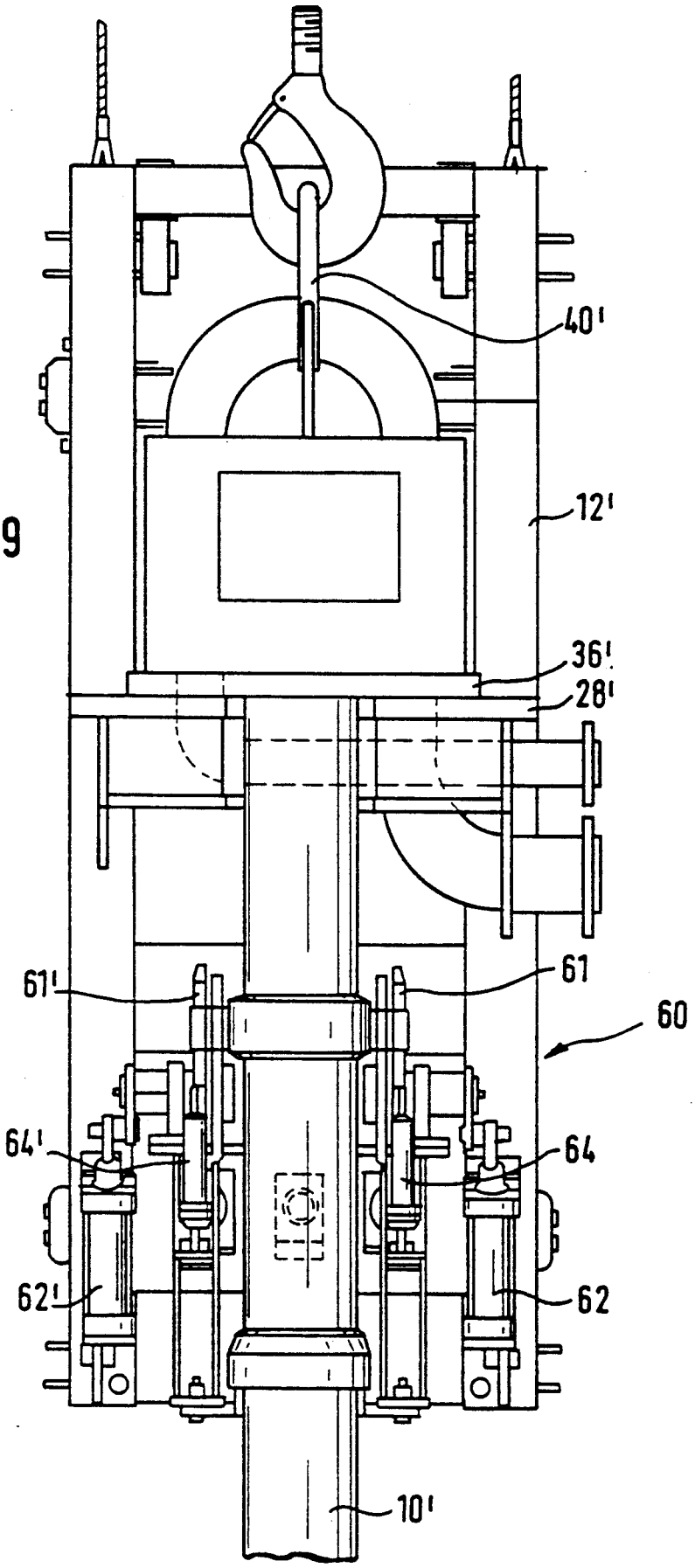
FIG. 9 is a front elevation view showing variation of the fastening and pressing device between the lance carriage and the top part of the lance.

FIG. 9 shows a second embodiment for producing the desired force pressing the plates 28' and 36' against one another and for additionally rigidly connecting the lance 10' to the lance carriage 12'. This system functions on the basis of a swivel hook arrangement 60, such as is described in U.S. patent application No. 716,720 filed Jun. 17, 1991, (which is assigned to the assignee hereof and incorporated herein by reference). An important difference between U.S. patent application No. 716,720 and the present invention is that in the U.S. patent application No. 716,720, the hooks serve essentially only for fastening the lance at a first point on the carriage, while the coupling force is produced by a second swivel hook arrangement. In contrast, the swivel hook arrangement 60 attends not only to the fastening of the lance 10' at a first or second point on the carriage 12', but also the the pressing of the two plates 36' and 28' against one another. For this purpose, the hook system must be so designed that on operation of its drives (the linear motors 62, 62' in FIG. 9) it pulls the lance 10' downwards. The fundamental mode of operation of a swivel hook arrangement of this kind can be seen in U.S. patent application No. 716,720.

It will be appreciated that, both in the embodiment according to FIGS. 3 and 4 and in that according to FIG. 9, pressure limiting means, for example in the form of load cells, are provided, which switch off the respective pressing system when a predetermined coupling pressure between the plates 28 and 36, or 28' and 36', respectively, is reached.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. Blowing lance suspension with integrated medium supply for mounting a metallurgical blowing lance on a lance carriage comprising:

a lance carriage comprising a medium collector box forming a fork-shaped carrier arm for the lance, a top carrier plate on said medium collector box, said top carrier plate having a substantially horizontal carrier connection surface at its upperside and first medium connections opening in said carrier connection surface; and a lance including on its top end a lance head plate having a lance connection surface, perpendicular to the longitudinal axis of the lance, at its underside and second medium connections opening in said lance connection surface, said lance connection surface lying on said carrier connection surface and said first medium connections cooperating with and corresponding to said second medium connections, when the lance is supported on the medium collector.

2. Blowing lance suspension according to claim 1 further comprising:

pressing means for additionally pressing the connection surface of said lance against the connection surface of said carriage; and fastening means for rigidly connecting a stem of the lance to the lance carriage.

3. Blowing lance suspension according to claim 2 wherein said fastening and pressing means comprises:

a clamp device having a fork-shaped projecting arm on the lance carriage, said clamp device being vertically slidable on the lance carriage and being hooked from above onto pin means located on a stem of said lance.

4. Blowing lance suspension according to claim 3 wherein:

said projecting arm can be pressed firmly against said pin means by means of a vertical drive.

5. Blowing lance suspension according to claim 2 wherein said fastening and pressing means comprises:

a pair of swivel hooks on said lance carriage, said swivel hooks being engageable in pin mean on a stem of said lance and associated drives pressing said swivel hooks against said pin means on the lance stem in the direction in which the force of gravity acts.

6. Blowing lance suspension according to claim 1 comprising:

lateral pipe connections on the medium collector for a gaseous blowing medium and inlet and return pipes for a liquid coolant for the lance, the pipe connections leading from below into the corresponding first medium connections opening in the carrier connection surface.

7. Blowing lance suspension according to claim 1 comprising:

connecting pipes between the lance and the medium connections opening in the lance connection surface, the connecting pipes leading from above into the corresponding second medium connections opening in the lance connection surface.

8. Blowing lance suspension according to claim 1 comprising:

fitting connection members for electrical lines in the lance and carrier connection surfaces.

9. Blowing lance suspension according to claim 1 comprising:

a transport eye on the top part of the lance disposed in the direct extension of the longitudinal axis of the lance.

* * * * *